US008499775B1

(12) United States Patent
Ma et al.

(10) Patent No.: US 8,499,775 B1
(45) Date of Patent: Aug. 6, 2013

(54) LEVERAGE-BASED LARGE-SIZED UMBRELLA

(76) Inventors: Joen-Shen Ma, Taipei (TW); Yung Cheng Ma, Taipei (TW)

( * ) Notice: Subject to any disclaimer, the term of this patent is extended or adjusted under 35 U.S.C. 154(b) by 0 days.

(21) Appl. No.: 13/370,423

(22) Filed: Feb. 10, 2012

(51) Int. Cl.
*A45B 25/14* (2006.01)
*A45B 25/02* (2006.01)

(52) U.S. Cl.
USPC ..... 135/27; 135/25.33; 135/20.3; 135/31

(58) Field of Classification Search
USPC ..... 135/15.1, 20.3, 25.33, 23, 27–29, 135/31–32
See application file for complete search history.

(56) References Cited

U.S. PATENT DOCUMENTS

| | | | | | |
|---|---|---|---|---|---|
| 873,174 | A | * | 12/1907 | Roller | 135/25.31 |
| 937,583 | A | * | 10/1909 | Edwards | 135/28 |
| 1,049,360 | A | * | 1/1913 | Hoffman | 135/25.33 |
| 1,055,924 | A | * | 3/1913 | Larsen | 135/25.33 |
| 1,177,739 | A | * | 4/1916 | Truitt | 135/27 |
| 1,369,996 | A | * | 3/1921 | Westbeld | 135/27 |
| 1,743,043 | A | * | 1/1930 | McLean | 135/27 |
| 4,007,753 | A | * | 2/1977 | DeMarco | 135/25.33 |
| 5,329,953 | A | * | 7/1994 | Becher | 135/31 |
| 5,361,792 | A | * | 11/1994 | Lin et al. | 135/24 |
| 7,318,443 | B1 | * | 1/2008 | Ma | 135/28 |
| 7,963,293 | B2 | * | 6/2011 | Ma | 135/20.3 |

FOREIGN PATENT DOCUMENTS

| | | | |
|---|---|---|---|
| FR | 2662918 | A * | 12/1991 |
| GB | 2382521 | A * | 6/2003 |
| JP | 2006116257 | A * | 5/2006 |

* cited by examiner

*Primary Examiner* — Winnie Yip
(74) *Attorney, Agent, or Firm* — Rosenberg, Klein & Lee

(57) ABSTRACT

An umbrella includes an internal shaft fit into an interior chamber of a central post. A cap is fixed to a top end of the internal shaft. An intermediate collar is movably fit to the central post and a runner located below the collar is fixed to the central post. Each of ribs has an inner end connected to the cap. Each of stretchers has two ends connected to the intermediate collar and the respective rib. Each of the driving bars has ends connected to the runner and the respective rib at a location between the connection of the rib to the cap and the connection of the rib to the respective stretcher. A connector is movably fit over the central post below the runner and is connected by a pull bar to the intermediate collar. The connector includes a fixing member engageable and fixable to the central post.

10 Claims, 3 Drawing Sheets

LEVERAGE-BASED LARGE-SIZED UMBRELLA

BACKGROUND OF THE INVENTION

1. Field of the Invention

The present invention relates to the technical field of umbrella for shading from sunlight and rain, and in particular to the technical field of large-sized beach umbrella.

2. The Related Arts

Umbrellas that are used as sunshade or rainshade are generally classified as two types, of which one is portable, while the other if fixed. The portable umbrellas are designed for the consideration of easy carrying so that they have a small size and light structure. On the other hand, the fixed umbrellas, such as beach umbrella and advertisement umbrella, which are both of large-sized umbrellas, often have a large size and heavy. The large-sized umbrellas are generally fixed outdoors for shading from sunlight or rain. The fixed umbrellas are often designed to allow of expansion and collapse for the purposes of easy storage, protection of the umbrellas against aging or deterioration caused by intense sun light, and protection against caused by gusts in the nighttime. Due to the large size and heavy weight, it takes a great effort in carrying out the expansion or collapse operation of the umbrellas. Further, in the operation of expansion or collapse, since the fixed large-sized umbrellas often have a runner that must be moved for a long stroke, for a short person, he or she needs a stool to stand thereon in order to move the runner to a predetermined height and secured in position to a central post in expanding the umbrella. This is effort consuming and difficult.

Known references, such as U.S. Pat. No. 5,361,792, disclose a self-opening umbrella that is operated by pushbutton based control means and such a known umbrella achieves the self-opening operation through a complicated control arrangement that includes a runner that is movable along a central shaft, an intermediate collar that is fixed to an upper end of the central shaft, and a cap that is fixed to the upper end of the central shaft. However, the disclosure of the known reference shows that such an arrangement is composed of a great number of parts and has an extremely complicated structure, making an umbrella incorporating such an arrangement very heavy and thus only fit for small-sized portable umbrellas and not applicable to the large-sized umbrellas discussed above.

SUMMARY OF THE INVENTION

Thus, an objective of the present invention is to provide a leverage-based large-sized umbrella that overcomes the technical problems of the conventional large-sized umbrellas of being effort-consuming in expanding and collapsing and being inconvenient to use.

To solve the technical problems discussed previously, the present invention adopts a solution that comprises a leverage-based large-sized umbrella, comprising: a central post, an internal shaft, a cap, an intermediate collar, a runner, ribs, stretchers, and driving bars.

The internal shaft is fit into an interior chamber of the central post. The cap is fixed to a top end of the internal shaft. The intermediate collar and the runner are fit over the central post. The runner is arranged below the intermediate collar. Each of the ribs has an inner end connected to the cap. Each of the stretchers has two ends respectively connected to the intermediate collar and the respective rib. Each of the driving bars has an end connected to the runner and an opposite end connected to the respective rib at a location between the connection of the rib to the cap and the connection of the rib to the respective stretcher, characterized in that the runner is fixed to the central post and the intermediate collar is movable fit to the central post; a connector is movably fit over the central post at a location below the runner, a pull bar is connected between the connector and the intermediate collar, and the connector comprises a fixing member that is engageable and fixable to the central post.

The fixing member comprises a tightening bolt that is substantially perpendicular to the central post.

The central post forms an umbrella-expansion locking slot that engages the tightening bolt when the umbrella is completely expanded.

The central post forms an umbrella-collapse locking slot that engages the tightening bolt when the umbrella is completely collapsed.

The central post forms an elongate groove that receives the pull bar therein.

The elongate groove has a semicircular cross section and the cross section has an opening forming projecting constraint blocks.

The tightening bolt has a head forming a hand grip.

The fixing member comprises a pushbutton and the central post comprises a resilient umbrella-expansion pawl engageable with the pushbutton.

The central post forms a resilient umbrella-collapse pawl engageable with the pushbutton.

A self-opening spring is arranged at a bottom of the internal shaft.

The effectiveness of the present invention is that according to the present invention, the runner is fixed to the central post. The driving bars that are connected to the runner serve as a fulcrum of leverage and the ribs serve as a lever so that the force that is required for opening the umbrella can be reduced to realize a technical effect of effort saving.

Further, the intermediate collar is connected by the pull bar to the connector located below the runner so that the umbrella can be opened through downward pulling the connector and this is different from the conventional way of opening umbrella. Since the large-sized umber may have an overall height that is greater than the height of an ordinary individual, downward pulling to open umbrella is more effort saving than upward pushing to open umbrella. Further, since the leverage principle is used in the present invention, the force that is needed for opening umbrella is substantially the same as that for closing umbrella, so that the umbrella can be expanded or collapsed with substantially consistent velocity in opening and closing operations of the umbrella and undesired influence on the nearby individuals or objects can be eliminated.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

The structure of an umbrella according to the present invention will be described in detail as follows, with reference to the attached drawings and a preferred embodiment thereof.

Figure 1:
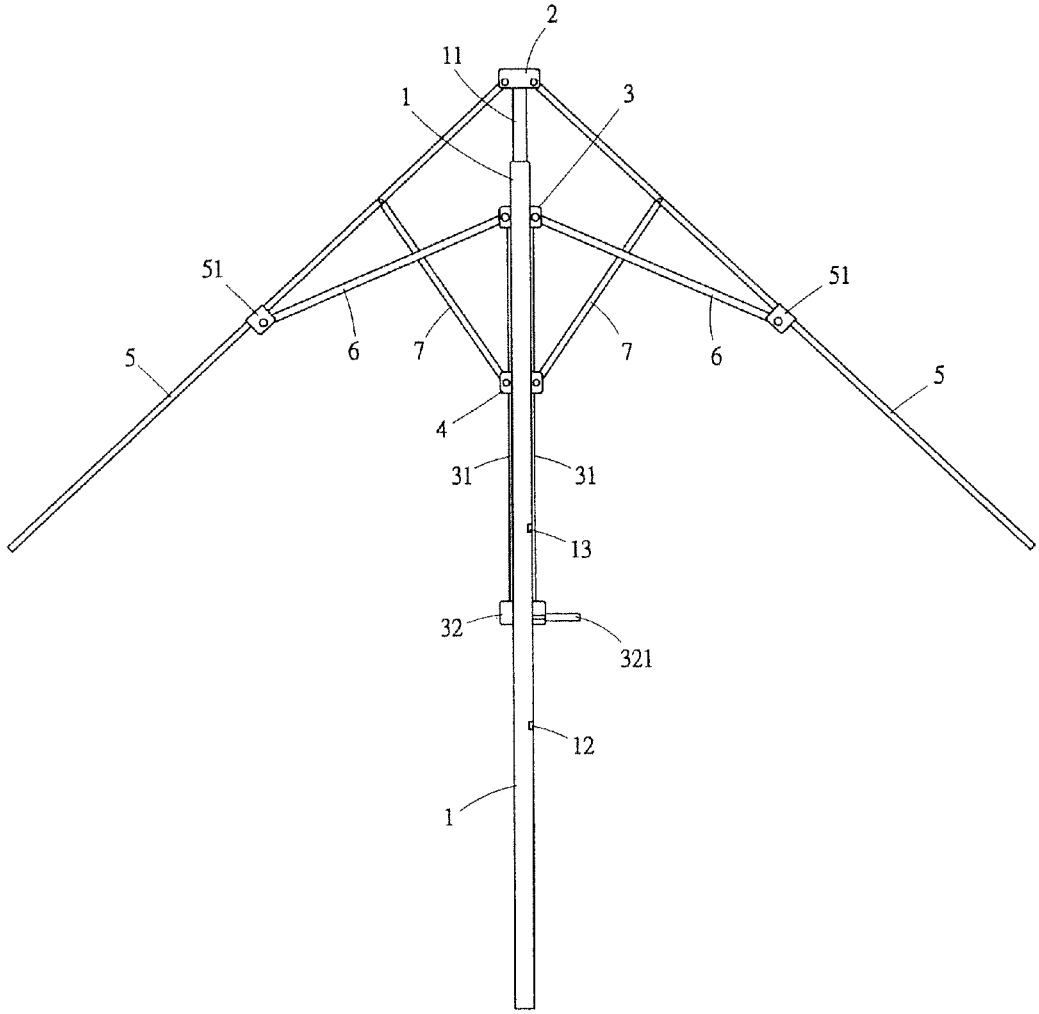
FIG. 1 is a side elevational view showing a frame structure of an umbrella constructed in accordance with an embodiment of the present invention.

With reference to the drawings and in particular to FIG. 1, the present invention provides an umbrella that comprises a central post 1, an internal shaft 11, a cap 2, an intermediate collar 3, a runner 4, ribs 5, stretchers 6, and driving bars 7.

The internal shaft 11 has a bottom end that is fit, from a top end of the central post 1, into an interior chamber of the central post 1. The internal shaft 11 is allowed to extend upward to project beyond the central post 1.

The cap 2 is fixed to a top end of the internal shaft 11. The runner 4 is fixed to the central post 1. The intermediate collar 3 is located between the cap 2 and the runner 4 and is movably fit over to the central post 1 so that the intermediate collar 3 is movable vertically along the central post 1.

A connector 32 is movably fit to the central post 1 at a location below the runner 4. Pull bars 31 are connected between the connector 32 and the intermediate collar 3. When the connector 32 is moved vertically along the central post 1, the intermediate collar 3 is moved vertically in unison therewith.

The connector 32 comprises a fixing member 321 that works with the central post 1 for fixing purposes.

The fixing member 321 can be a tightening bolt that is set substantially perpendicular to the central post 1. The tightening bolt has a head in the form of a hand grip to facilitate moving the connector 32 and easy twisting of the tightening bolt.

To selectively and releasably secure the connector 32 to the central post 1, the central post 1 forms an umbrella-expansion locking slot 12 and an umbrella-collapse locking slot 13 that are engageable with the tightening bolt.

Further, besides the structure described above, the fixing member 321 can alternatively be a pushbutton and the central post 1 is provided with a resilient umbrella-expansion pawl and a resilient umbrella-collapse pawl that is operative with the pushbutton.

Each of the ribs 5 has an end connected to the cap 2. The end of each rib 5 is received in a mounting slot defined in the cap. The ribs 5 function to open a canopy and when the ribs 5 expand, the canopy is opened.

Each of the stretchers 6 has two ends respectively fixed to the intermediate collar 3 and a respective one of the ribs 5. Each rib 5 is coupled to a coupler 51, so that the ribs 5 and the stretchers 6 are movably coupled through the couplers 51.

Each of the driving bars 7 has an end connected to the runner 4 and an opposite end connected to a respective one of the ribs 5. The connection of said opposite end of the driving bar to the rib is located between the cap connection of the rib and the stretcher connection of the rib. In other words, it is located between the end of the rib 5 connected to the cap and the coupler 51.

Figure 2:
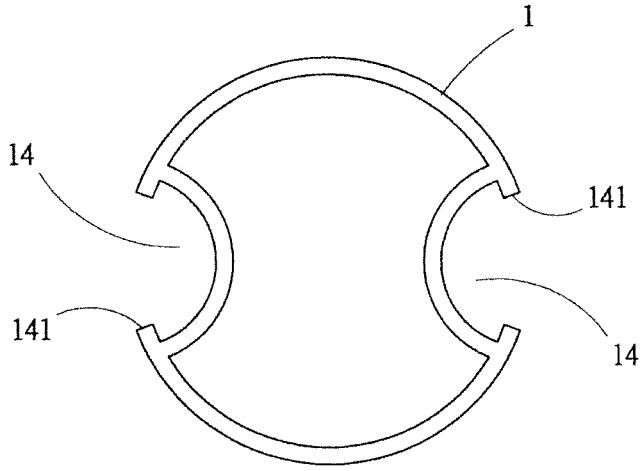
FIG. 2 is a cross-sectional view of a central post of the umbrella according to the present invention.

Referring to FIGS. 1 and 2, to allow the pull bars 31 to extend through the runner 4 to have top and bottom ends thereof respectively connected to the intermediate collar 3 and the connector 32, the central post 1 forms a pair of elongate grooves 14 for respectively receiving the pull bars 31 therein. The elongate grooves 14 have a cross-section that is semicircular. To prevent the pull bar 31 received in the elongate groove 14 from undesirably getting out of the groove, the elongate groove 14 is provided at an opening of the cross-section thereof with projecting constraint blocks 141. Of course, in an alternative embodiment, the runner 4 forms vertical channels in an inner side thereof for receiving the pull bars 31 and the central post 1 therein in a juxtaposed manner.

The operation of the present invention is that to open the umbrella, a user uses one hand to hold and downward move the hand-grip like fixing member 321 of the connector 32 to the umbrella-expansion locking slot 12. The fixing member 321 then engages the umbrella-expansion locking slot 12 for fixing. In the downward movement, the intermediate collar 3 is caused to move downward and the stretchers 6 push away the ribs 5. As being constrained by the driving bars 7, the ribs 5 apply a downward force with inner ends thereof to cause the cap 2 and the internal shaft 11 to move downward. At the same time, the driving bars 7 are rotated downward about the runner 4.

To collapse the umbrella, the operation is reversed. The user uses a hand to hold and move upward the hand-grip like fixing member 321 of the connector 32 to the umbrella-collapse locking slot 13. The fixing member 321 then engages the umbrella-collapse locking slot 13. In the upward movement, the stretchers 6 pull the ribs 5 inward. As being constrained by the driving bars 7, the ribs 5 apply an upward force with the inner ends thereof to cause the cap 2 and the internal shaft 11 to move upward. At the same time, the driving bars 7 are rotated upward about the runner 4.

To realize self-closing of the umbrella, a self-closing spring can be provided at the bottom end of the internal shaft 11.

Figure 3:
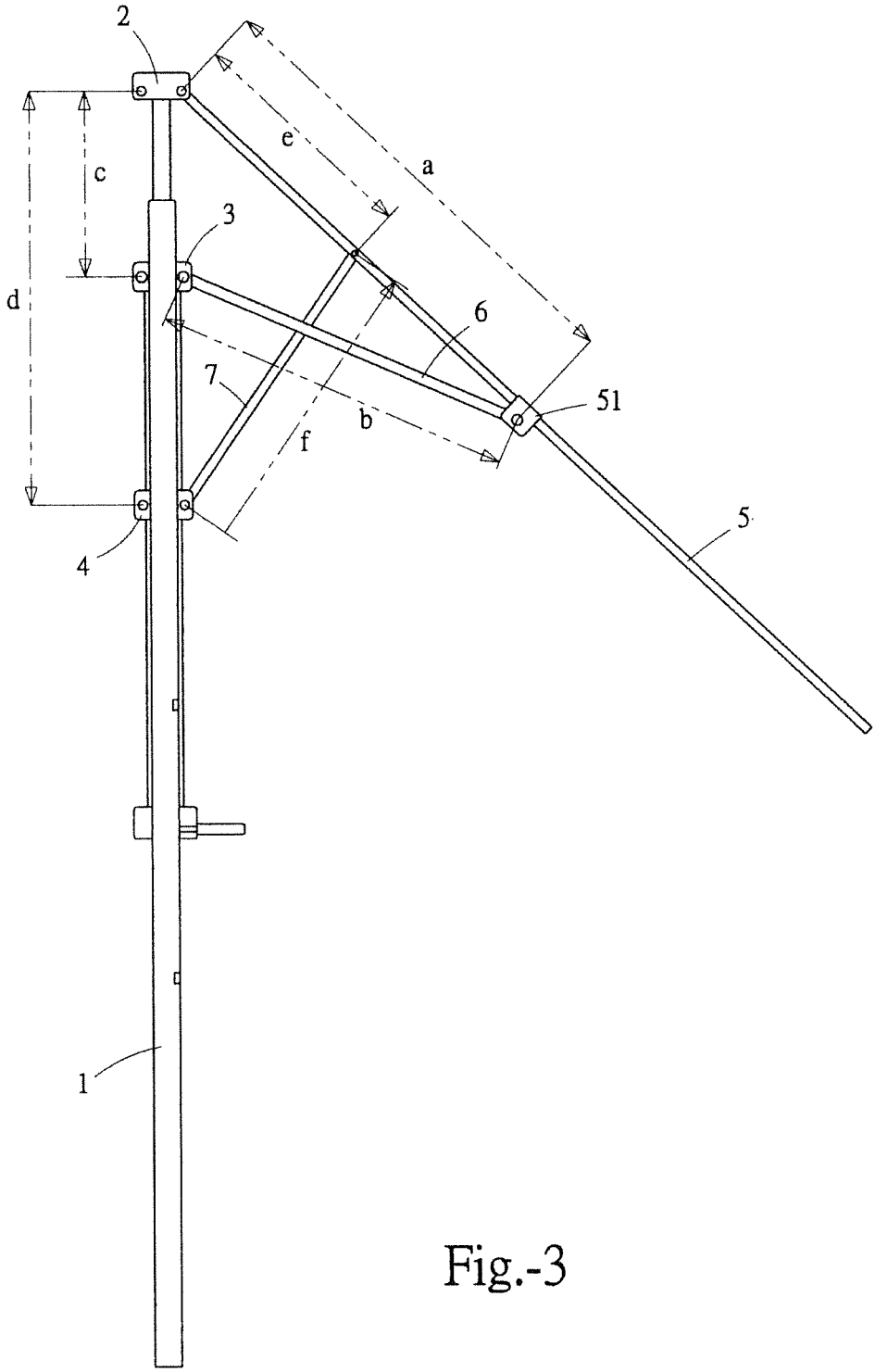
FIG. 3 is a side elevational view showing the principle of constructing the umbrella of the present invention.

Referring to FIG. 3, when the umbrella of the present invention is in a completely collapsed condition, ideally, the distance a between the cap 2 and the coupler 51 is equal to the sum of the length b of the stretchers 6 and the distance c between the cap 2 and the intermediate collar 3; the distance d between the cap 2 and the runner 4 is equal to the sum of the distance e between the cap 2 and outer ends of the driving bars 7 and the length f of the driving bars 7.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A leverage-based large-sized umbrella, comprising: a central post, an internal shaft, a cap, an intermediate collar, a runner, ribs, stretchers, and driving bars, the internal shaft being fit into an interior chamber of the central post, the cap being fixed to a top end of the internal shaft, the intermediate collar and the runner being fit over the central post, the runner being arranged below the intermediate collar, each of the ribs having an inner end connected to the cap, each of the stretchers having two ends respectively connected to the intermediate collar and the respective rib, each of the driving bars having an end connected to the runner and an opposite end connected to the respective rib at a location between the connection of the rib to the cap and the connection of the rib to the respective stretcher, characterized in that:

the runner is fixed to the central post and the intermediate collar is movable fit to the central post; a connector is movably fit over the central post at a location below the runner, a pull bar is connected between the connector and the intermediate collar, and the connector comprises a fixing member that is engageable and fixable to the central post.

2. The leverage-based large-sized umbrella as claimed in claim 1, characterized in that the fixing member comprises a tightening bolt that is substantially perpendicular to the central post.

3. The leverage-based large-sized umbrella as claimed in claim 2, characterized in that the central post forms an umbrella-expansion locking slot that engages the tightening bolt when the umbrella is completely expanded.

4. The leverage-based large-sized umbrella as claimed in claim 2 or 3, characterized in that the central post forms an umbrella-collapse locking slot that engages the tightening bolt when the umbrella is completely collapsed.

5. The leverage-based large-sized umbrella as claimed in claim 1, characterized in that the central post forms an elongate groove that receives the pull bar therein.

6. The leverage-based large-sized umbrella as claimed in claim 5, characterized in that the elongate groove has a semicircular cross section and the cross section has an opening forming projecting constraint blocks.

7. The leverage-based large-sized umbrella as claimed in claim 2, characterized in that the tightening bolt has a head forming a hand grip.

8. The leverage-based large-sized umbrella as claimed in claim 1, characterized in that the fixing member comprises a pushbutton and the central post comprises a resilient umbrella-expansion pawl engageable with the pushbutton.

9. The leverage-based large-sized umbrella as claimed in claim 8, characterized in that the central post forms a resilient umbrella-collapse pawl engageable with the pushbutton.

10. The leverage-based large-sized umbrella as claimed in claim 1, characterized in that a self-opening spring is arranged at a bottom of the internal shaft.

* * * * *